United States Patent [19]

Stephenson

[11] 4,356,582

[45] Nov. 2, 1982

[54] POOL SWEEP BRUSH

[76] Inventor: Thomas G. Stephenson, 7881 Birchwood, La Palma, Calif. 90623

[21] Appl. No.: 264,285

[22] Filed: May 18, 1981

[51] Int. Cl.[3] ..... E04H 3/20

[52] U.S. Cl. ..... 15/1.7; 15/160; 134/167 R

[58] Field of Search ..... 15/1.7, 160 R; 134/167 R

[56] References Cited

U.S. PATENT DOCUMENTS

| | | | |
|---|---|---|---|
| 2,982,971 | 5/1961 | Garaway | 15/1.7 X |
| 3,170,180 | 2/1965 | Winston et al. | 15/1.7 |
| 3,872,533 | 3/1975 | Proffit | 15/1.7 |

*Primary Examiner*—Edward L. Roberts

*Attorney, Agent, or Firm*—Fischer, Tachner & Strauss

[57] ABSTRACT

There is disclosed a brush which is suitable for installation and use on the flexible hose of a conventional pool sweep. The brush is useful as a substitute for the wear rings which are used on the hoses. Typically, the flexible hose of a pool sweep is provided with a plurality of these wear rings which are rotatably mounted on the hose and are captured between fixed collars secured on the hose. These rollers reduce the drag of the hose against the surface of the pool and minimize the wear on the hose. This function is also provided by the brushes on my invention which also serve to scrub or scour the surfaces of the pool, greatly improving the cleaning efficiency of the device.

6 Claims, 8 Drawing Figures

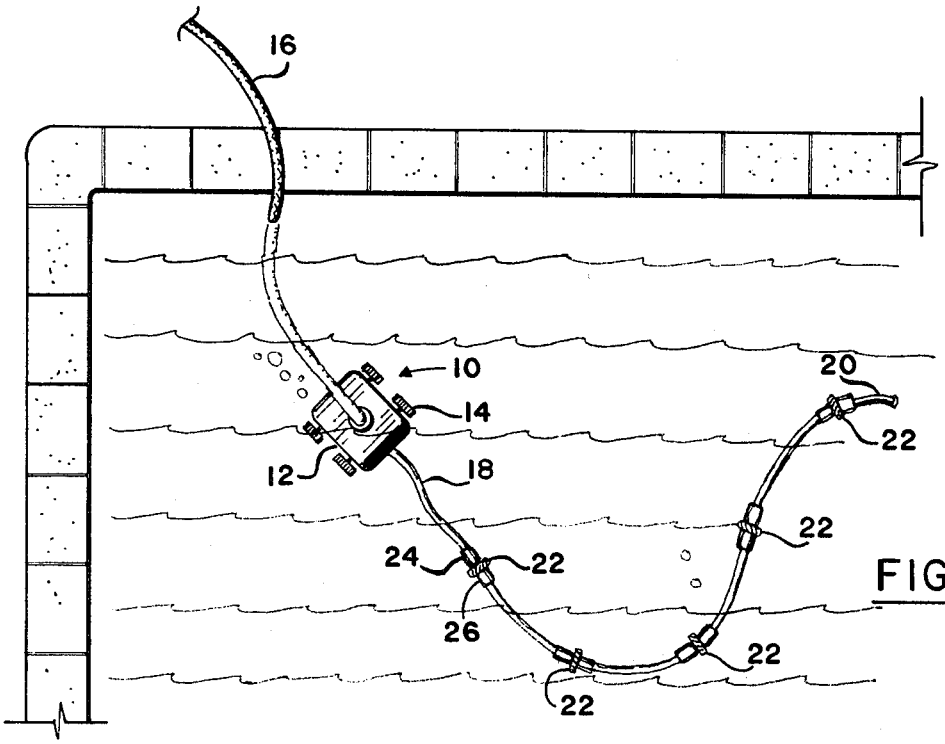
FIG. 1
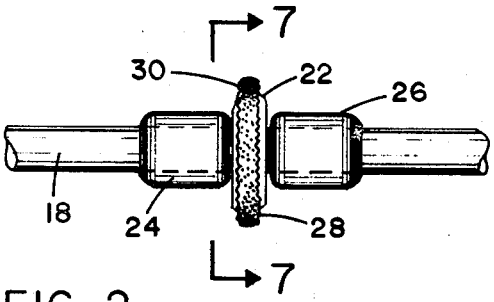
FIG. 2
FIG. 3
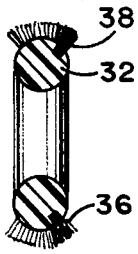
FIG. 4
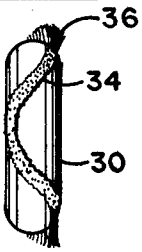
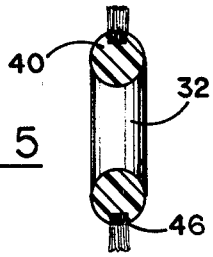
FIG. 5
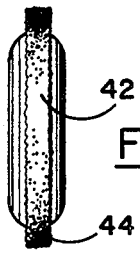
FIG. 6
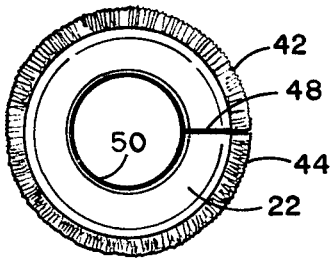
FIG. 7
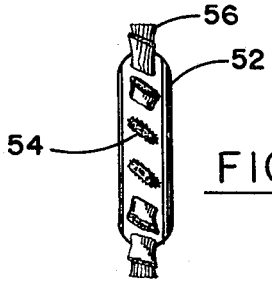
FIG. 8

POOL SWEEP BRUSH

BACKGROND OF THE INVENTION

1. Field of Invention

This invention relates to swimming pool cleaning devices and, in particular, to the automatic pool cleaning and sweeping devices.

2. Brief Statement of the Prior Art

Automatic pool cleaning equipment typically uses a water powered drive mechanism to propell a central unit across the water surface in the pool or to drive a submersed unit across the bottom surface of the pool. A flexible hose with a water jet discharge nozzle is attached to the central unit and the reaction from the water jet of the nozzle causes the latter to oscillate and induces a sweeping action to the flexible hose. Commonly, the hose is provided with a plurality of wear rings or collars which are freely rotatably mounted on the hose and retained in position by a pair of collars fixedly carried on the hose. These collars are commonly molded of polyurethane rubber and have a radial slit to permit their replacement when worn. The successful use of the cleaning equipment requires that these wear rings move freely on the surface of the pool to minimize drag of the hose and thus ensure a minimum resistant of the hose to flexing or whipping across the surface of the pool.

None of the pool cleaning equipment which is presently available provides any scrubbing or scouring action on the pool surfaces. Accordingly, it is frequently necessary to scrub the surfaces manually to maintain a clean and new appearance to the pool. While attempts have been made to provide brushes on a flexible hose, such as in U.S. Pat. Nos. 2,982,971 and 3,872,533, the brushes used in these attempts cannot be used successfully with the automatic pool cleaning equipment because they require a very high pressure supply of water to operate the brushes or to overcome the excessive drag the brushes experience against the surface of the pool. If used with the automated pool cleaning equipment these brushes would effectively inhibit the whipping action of the flexible hose.

BRIEF STATEMENT OF THE INVENTION

This invention comprises the use of one or more roller brushes which are mounted at one or more locations along the length of the flexible hose of an automatic pool cleaning device. The roller brushes are freely rotatably mounted on the hose and thus avoid inhibiting the freedom of the flexible hose to whip or flex and use. The roller brushes which are used in this application comprise rings having a radial slit to permit them to be inserted over the hose and retained thereon between the collars which are fixably attached to the hose and which provide the journal support for the roller brushes. Each roller brush has a plurality of radially directed bristles which are supported and project from the outer edge of the ring body of the roller brush. In use, these roller brushes are freely rotatably about the hose and are retained in a preset axial location on the hose, secured there by the fixed collars. The roller brushes can be interchanged with the wear rings which are commonly used on the flexible hose of the automatic pool cleaning equipment.

BRIEF DESCRIPTION OF THE DRAWINGS

The invention will be described with reference to the figures of which:

FIG. 1 is a plan view of a typical automatic pool cleaning device;

FIG. 2 is a view of a portion of the flexible hose of the device of FIG. 1;

FIG. 3 is a cross-sectional view of a roller brush of the invention;

FIG. 4 is a unsectioned view of the roller brush of FIG. 3;

FIG. 5 is a cross-sectional view of another embodiment of the roller brush of the invention;

FIG. 6 is an unsectioned view of the roller brush of FIG. 5;

FIG. 7 is a side view of a typical roller brush used in the invention; and

FIG. 8 is a view of a preferred roller brush embodiment.

DESCRIPTION OF PREFERRED EMBODIMENT

Referring now to FIG. 1, the invention is shown as applied to a conventional automatic pool sweep mechanism 10. The mechanism comprises a housing 12 which houses a water driven motor such as a turbine that is geared to drive or propel housing 12 either across the surface of the pool or along the bottom surface of the pool. In the illustrated embodiment, housing 12 is submersed and has a plurality of wheels 14 which are driven to direct the housing over the surface of the pool in a random or predetermined pattern. Water under pressure is supplied to housing 12 through the water supply hose 16 which operates on waterline pressure or by the swimming pool pump pressure.

The mechanisms, whether they float on the water surface or roll on the bottom surface of the pool, include a flexible water hose such as 18 which has a distal water nozzles 20 adapted to discharge a jet stream of water. The reaction of the jet water discharge from nozzle 20 causes this nozzle to oscillate on the end of the hose and induces a whipping action to the length of the hose so that debris on the bottom of the pool is swept across the surface to a location where it can be removed. The hose is protected against wear by a plurality of wear rings 22 which are positioned at spaced-apart locations along the length of the hose. These wear rings are freely rotatable about the hose and commonly are molded polyurethane wheels having a slit to permit the rings to be slipped over the hose. The wear rings are axially retained on the hose by a pair of spaced-apart collars 24 and 26 that are fixably secured to the hose.

The flexible hose as modified in accordance with the invention is shown in greater detail in FIG. 2. The illustrated portion of the hose 18 has two, spaced-apart collars 24 and 26. These are fixably secured to the hose by solvent welding, cementing and the like. The two collars are spaced apart at appropriate distance to permit the insertion of a roller brush 22. The common wear ring which has heretofore been employed is a simple, molded ring of polyurethane rubber. While this ring serves the function of reducing wear on the hose and enhancing the freedom of the hose to whip or move under the water jet reaction effect, these polyurethane rings do not facilitate any scouring or scrubbing of the pool surface.

The invention is shown as applied to the conventional hose structure by the use of the roller brush of the invention. Each roller brush has a peripheral roll 28 of radially directed bristles 30. The roller brush is freely rotatably mounted on hose 18 such that movement of the hose will cause rotation of the roller brush across the surface of the pool.

The structure of the roller brushes of the invention is shown in greater detail in FIGS. 3–8. The particular embodiment of FIGS. 3 and 4 comprises a roller ring 30 which can have a cylindrical cross-section 32, as shown in FIG. 3. Disposed about the periphery of roller 30 is a row 34 of stiff bristles 36. The row 34 can be a continuous, helically disposed row of bristles as shown in FIG. 4. The roller brush of the invention is fabricated by molding the roller ring 30 of a suiable material such as polyurethane rubber and, during the molding operation, embedding into the outer periphery of the roller the plurality of bristles 36. As shown in FIG. 3, a portion 38 of the length of these bristles can be embedded into the body of the ring 32. The bristles which are used can be formed of any suitable material such as natural materials, e.g., hog hair bristles and the like or can be fabricated or synthetic materials such as nylon, polyester, and the like.

Referring now to FIGS. 5 and 6, an alternative construction of the roller brushes is illustrated. As there illustrated, each roller brush has a ring body 32 which can be of circular cross-section as indicated at 40. Each roller brush can have a peripheral row 42 of stiff bristles 44 which are secured in the ring 32 by being embedded in the ring as shown at 46 during molding of the ring.

FIG. 7 is a side view of a roller brush 22 which has a single peripheral row 42 of bristles 44. The ring has a single radial slit 48 which permits the ring to be spread open sufficiently to be placed over the flexible hose 18, thereby permitting its insertion between the stationary collars 24 and 26, shown in FIG. 2. The internal diameter 50 of the roller brush 22 should be sufficiently great to permit its free rotation on the flexible hose 18, thereby ensuring freedom of rotation of this roller brush as the hose is flexed and moves across the surface of the pool. During this flexing, the roller brush will roll and will be dragged across the surface of the pool and will scour and/or scrub the pool surface during the normal operations of the automatic pool cleaner.

A preferred embodiment of the roller brush is shown in FIG. 8. This brush 52 has a plurality of rows 54 of bristles 56. These rows are inclined to the plane of the roller at an angle sufficient to insure that the brush will roll along the surface as its supporting hose is moved by the jet reaction effect of water discharging from the hose nozzle. A suitable angle of inclination of the rows 54 to the plane of the roller is from 20 to about 70 degrees, preferably from 40 to 50 degrees.

The invention has been described with reference to the illustrated and presently preferred embodiments. It is not intended that the invention be unduly limited by this disclosure of the illustrated and presently preferred embodiment. Instead, it is intended that the invention be defined by the means, and their obvious equivalents, set forth in the following claims.

What is claimed is:

1. In an automatic cleaner for a swimming pool comprising an elongated flexible hose having a discharge nozzle and supplied with water at sufficient pressure to create a water jet reaction effect sufficient to oscillate the end of said hose and said nozzle and move said hose across the surface of said pool and wherein said hose is provided with a plurality of fixed collars to journal rotatable rings at spaced-apart locations, the improvement which comprises positioning a plurality of ring brushes about said hose, each ring brush comprising a ring which is freely rotatably received over said hose and journalled between said fixed collars and a plurality of stiff bristles supported on and radially projecting from the outer edge of said ring.

2. The automatic cleaner of claim 1 wherein said stiff bristles form a peripheral row of bristles about the outer edge of said ring.

3. The automatic cleaner of claim 1 wherein said plurality of stiff bristles are disposed in a helical row about the outer edge of said roller.

4. The automatic cleaner of claim 1 wherein each of said plurality of ring brushes is provided with a radial slit to permit its replacement on said flexible hose.

5. The automatic cleaner of claim 1 wherein said flexible hose is attached to a central housing which floats on the surface of the pool.

6. The automatic cleaner of claim 1 wherein said flexible hose is attached to a central housing which rests on the bottom surface of the pool.

* * * * *